United States Patent [19]

Pagnozzi et al.

[11] 4,176,466

[45] Dec. 4, 1979

[54] APPARATUS FOR DRYING TIMBER

[76] Inventors: Ernesto G. Pagnozzi, Via Camponuova, Cairo Montenotte (Savona); Vincenzo Pagnozzi, Rocchetta di Cairo (Savona), both of Italy

[21] Appl. No.: 794,587

[22] Filed: May 6, 1977

[30] Foreign Application Priority Data

May 12, 1976 [IT] Italy ..... 68164 A/76

[51] Int. Cl.[2] ..... F26B 9/06

[52] U.S. Cl. ..... 34/233; 34/530; 34/232

[58] Field of Search ..... 34/29, 229, 191, 222, 34/230, 232, 233; 239/225

[56] References Cited

U.S. PATENT DOCUMENTS

| | | | |
|---|---|---|---|
| 1,829,139 | 10/1931 | Henderson | 34/222 X |
| 2,001,001 | 5/1935 | Thelen | 34/191 |
| 2,548,403 | 4/1951 | Smith | 34/191 |

*Primary Examiner*—Benjamin R. Padgett
*Assistant Examiner*—E. Suzanne Parr
*Attorney, Agent, or Firm*—Sughrue, Rothwell, Mion, Zinn and Macpeak

[57] ABSTRACT

A method of kiln drying timber in a kiln chamber by directing a restricted jet of hot air or gas over timbers in the stack and cyclically varying the direction of the jet in order to play the heated air or gas over the whole of the stack. A kiln for performing the method comprises a generally cylindrical kiln chamber having an elongate nozzle along one wall parallel to the axis of the cylinder and pivotable about an axis parallel to the axis of the cylinder; a group of fans arranged in a row parallel to the axis of the chamber draws gas or air from within the chamber and directs it along conduits one surface of which is a heat exchange surface to the nozzle where it is directed back into the kiln chamber. The heat exchange surface of the conduits may be heated in any known way, by means of heaters or by forming it as one surface of a water jacket.

11 Claims, 3 Drawing Figures

APPARATUS FOR DRYING TIMBER

This invention relates to an improved process for drying timber and to an installation for performing the process. The process of the invention may be performed using air (or other gas) during one or more stages or during the whole drying process, and also may be performed using air or other gas at a pressure above or below atmospheric pressure.

The main technical problem which is solved by this invention is that of making the distribution of air inside a stack of timber to be dried substantially uniform. A subsidiary technical problem which is solved by this invention is that of avoiding the inconveniences caused in prior art methods by faulty stacking of the timber.

Those skilled in this art are well aware of the importance of uniformity in the distribution of air through the stack of timber in a timber drying kiln in order to obtain correct drying in the shortest possible time without splitter or warping the timber, and kiln manufacturers have utilised various different devices in order to try to equalise the speed of air flow through all parts of the stack of timber in the kiln. For example, metal deflectors have been used, as have grilles of bars extending horizontally or vertically; likewise slanting screens have been used in an attempt to direct the air to flow uniformly through all parts of a stack of timber in the kiln. In one known kiln the profile of the inside walls of the kiln, and the relative positions of these walls and of the heater elements and the fans have been determined by aerodynamic considerations in an attempt to ensure that air flow through the stack shall be as uniform as possible without there being any parts of the stack where the air is stationary, but the result of all these efforts is, in practice, of little effect because, although the devices used operate satisfactorily when the stack of timber is carefully constructed to a predetermined geometry it is, in practice, difficult or impossible to ensure that the stack has the precise geometry required, and although the aerodynamic shape of the kiln may accurately give the required effect when the stack is aerodynamically accurate, even a single variation of the characteristics of a portion of the flow path of the drying gas, due to variations in the stack, can influence the flow of gas in a manner which cannot be predicted.

Thus, in all known kilns, accurate and careful stacking is of fundamental importance to the success of the drying operation and many failures in the drying of timber can be attributed to inaccurate or careless stacking of the timber in the kiln.

In fact, kiln manufacturers produce very precise instructions which should be carefully followed when stacking the kiln but those who use the kiln frequently find it difficult to follow these instructions as closely as required for satisfactory results.

A further disadvantage of kilns which circulate heated air is that in order to obtain the required air flow pattern through the timber stack it is necessary to fill the kiln completely. If it is not possible completely to fill the kiln, it is necessary to use suitable screens to simulate the missing part of the timber stack. The object of this invention is to avoid such disadvantage.

The problem of avoiding the occurrence of pockets of stationary air in the stack has not until now been considered by those skilled in this art, although its importance is evident. In fact the occurrence of stationary air pockets in the stack of timber, causes a great variation in the degree of drying between one point and the other of the timber, sometimes with disastrous consequences for its structural integrity.

Also the problem of controlling the action of the air on the timber, has not until now been fully considered, largely as a result of lack of information on the mechanism which regulates the action of the exchange of heat and moisture between the timber and the air or other drying gas. In fact, when timber is subject to simultaneous variations of temperature and humidity, very complicated phenomena of deformation occur, and attempts to quantify such deformations of the timber have until now been unsuccessful. As a result of extensive tests which we have carried out on timber of different kinds and different thicknesses, and with different moisture contents, we have found that deformations within the timber causing inner tensions and resulting in warping or splitting of the timber, can be very much reduced if the temperature of the timber is raised gradually in a manner which will be described more fully below, so as to avoid setting up a significant temperature gradient within the timber.

According to one aspect of the present invention a process for drying timber using air or other gas, is characterised in that gas or air is directed to flow over each portion of a stack for successive periods of time spaced by invervals when no air or gas flows over the portion.

According to another aspect of the invention a timber drying kiln of the type in which a heated gas such as air is circulated within a closed chamber, is characterised in that within the chamber there is a nozzle for directing the flow of gas, the nozzle being mounted so that it can be pointed in different directions to direct gas onto a portion of the stack of timber, and means for cyclically varying the direction of the nozzle whereby to direct the jet of gas sequentially over all the parts of adjacent face of the stack of timber in turn.

One advantage of this invention is tht of allowing a timber drying kiln to be loaded, or even partially loaded with timber, without requiring the loading to be effected in a very precise manner whilst nevertheless avoiding the formation of idle short circuits of air flowing around the outside of the stack of timber rather than through the stack of timber.

Another advantage of this invention is that, again without requiring very precise stacking, the formation of stationary pockets of air due to air flowing preferentially along certain paths is avoided.

Finally, and most importantly, this invention offers the advantage of close control of the rate of temperature rise in the timber in relation to the capacity of the timber to absorb heat and lose moisture without splitting or warping.

Further characteristics and advantages of this invention will become apparent from a consideration of the following detailed description, in which reference is made to the accompanying drawings, and which is given purely as a non-limitative example.

Figure 1:
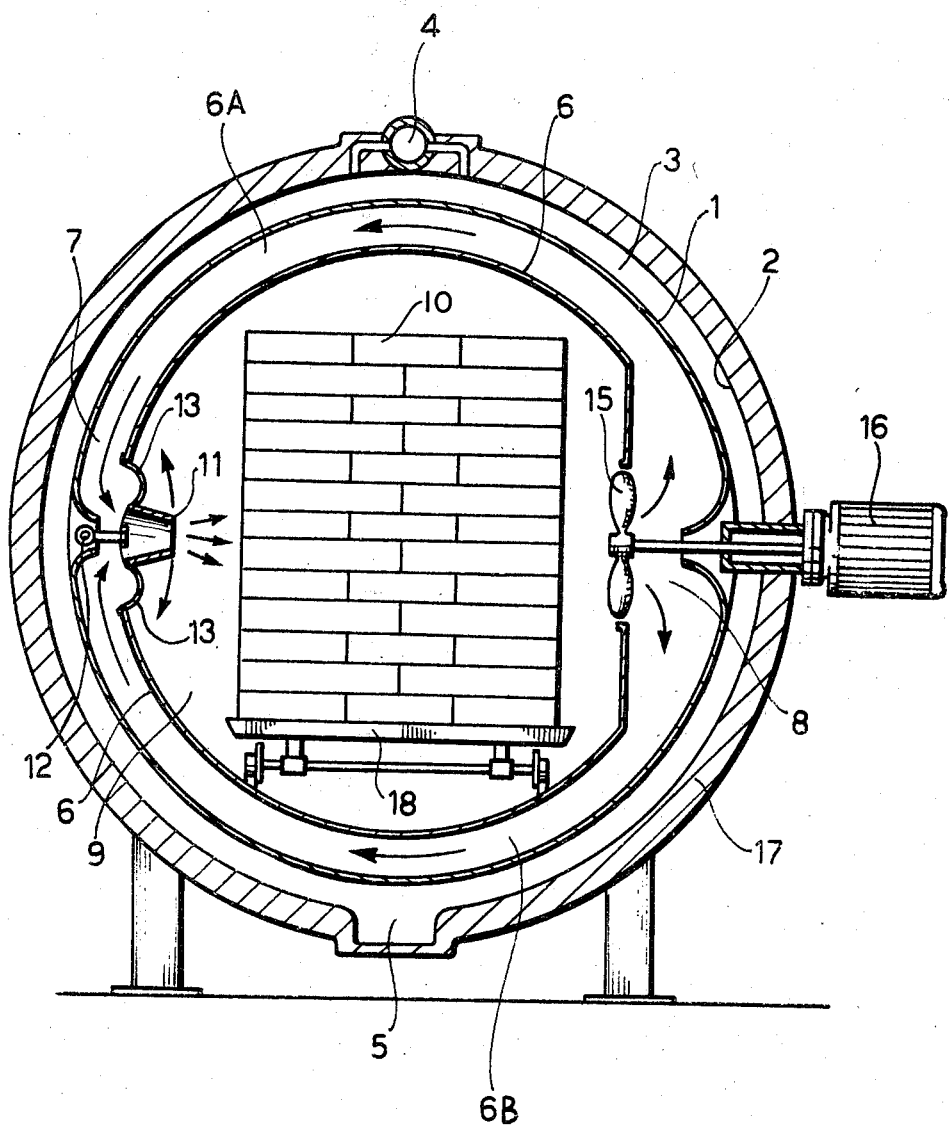
FIG. 1 is a cross section of a vacuum kiln according to this invention.
Figure 2:
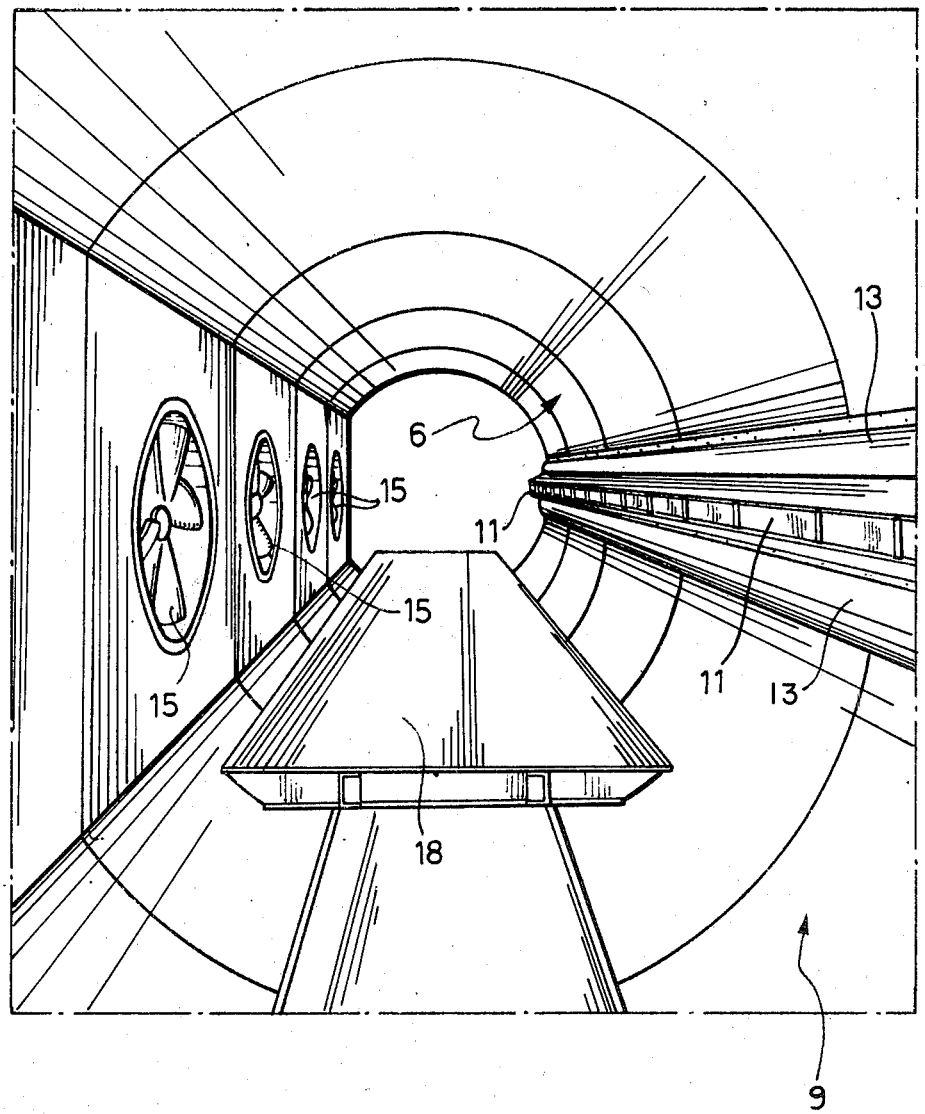
FIG. 2 is a perspective view of the inside of the kiln shown in FIG. 1.

Referring now to the drawings, and particularly to FIGS. 1 and 2 thereof, there is shown a vacuum kiln having a main wall 1 of sheet steel in the form of a horizontal cylinder in order to be able to withstand a vacuum being formed within it. Surrounding the wall 1 and spaced from it to form a cavity 3 is an outer casing 2. Within the intermediate cavity 3 circulates heated water which enters the cavity 3 through a supply duct 4 having a plurality of branch passages and leaves through a return duct 5.

Inside the main wall 1 there is a secondary wall 6 which may be, for example, of aluminum; the wall 6 is substantially parallel to the main wall 1. The inner cavity between the main wall 1 and the secondary wall 6 forms two half-cylindrical ducts 6A and 6B, which surround an inner chamber 9 defined by the inner wall 6, in which the stack 10 of timber to be dried is formed. The two half-cylindrical ducts 6A and 6B have a common input end 8 and a common output end 7. At the output end 7, which extends axially of the inner cylindrical chamber 9 across the width of the ducts 6A, 6B there is an output nozzle 11 which also extends across the width of the ducts 6A, 6B. The nozzle 11 is carried on a turnable shaft 12 so that it can turn about an axis parallel to the axis of the inner chamber 9 through an angle as indicated by the arrows in FIG. 1. The nozzle 11 is supported on the inner cylindrical wall 6 by flexible supports 13 which seal the ducts 6A, 6B from the chamber 9 and at the same time permit the angular movement of the nozzle 11. The two conduits 6A and 6B are narrow in relation to the length from the input end 8 to the output end 7 and shaped to encourage the air passed therealong to swirl with eddying turbulent motion to facilitate heat exchange with the wall 1.

At the common input end 8 of the conduits 6A and 6B there are located a plurality of fans 15 mounted on shafts which pass through the wall 1 and casing 2 in hermetically sealed bearings. The shafts are driven by motors 16 on the outside of the casing 2. The nozzle 11 and the fans 15 are located in diametrically opposite positions as illustrated in FIGS. 1 and 2.

The casing 2 is lined with a layer of thermal insulating material 17 so that the heat supplied by the hot water is transferred only through the wall 1, which acts as a heat exchange surface with the air inside the chamber 9 without any appreciable heat loss through the casing 2.

Of course heating of the wall 6 could be achieved by supplying the wall 6 with heaters able to raise the temperature of the wall 6 to the desired level, or such heaters could be used as well as the water jacket illustrated. If all the heating is achieved by means of heaters on the wall 6, the main wall 1 can be made from a thermal insulating material, for example concrete filled with materials to improve the thermal insulation and the casing 2 can be dispensed with.

The stack 10 of timber is supported on a trolley 18 which is loaded with transverse timbers spaced by laths in the usual way to allow the passage of air between the timbers in the stack.

Figure 3:
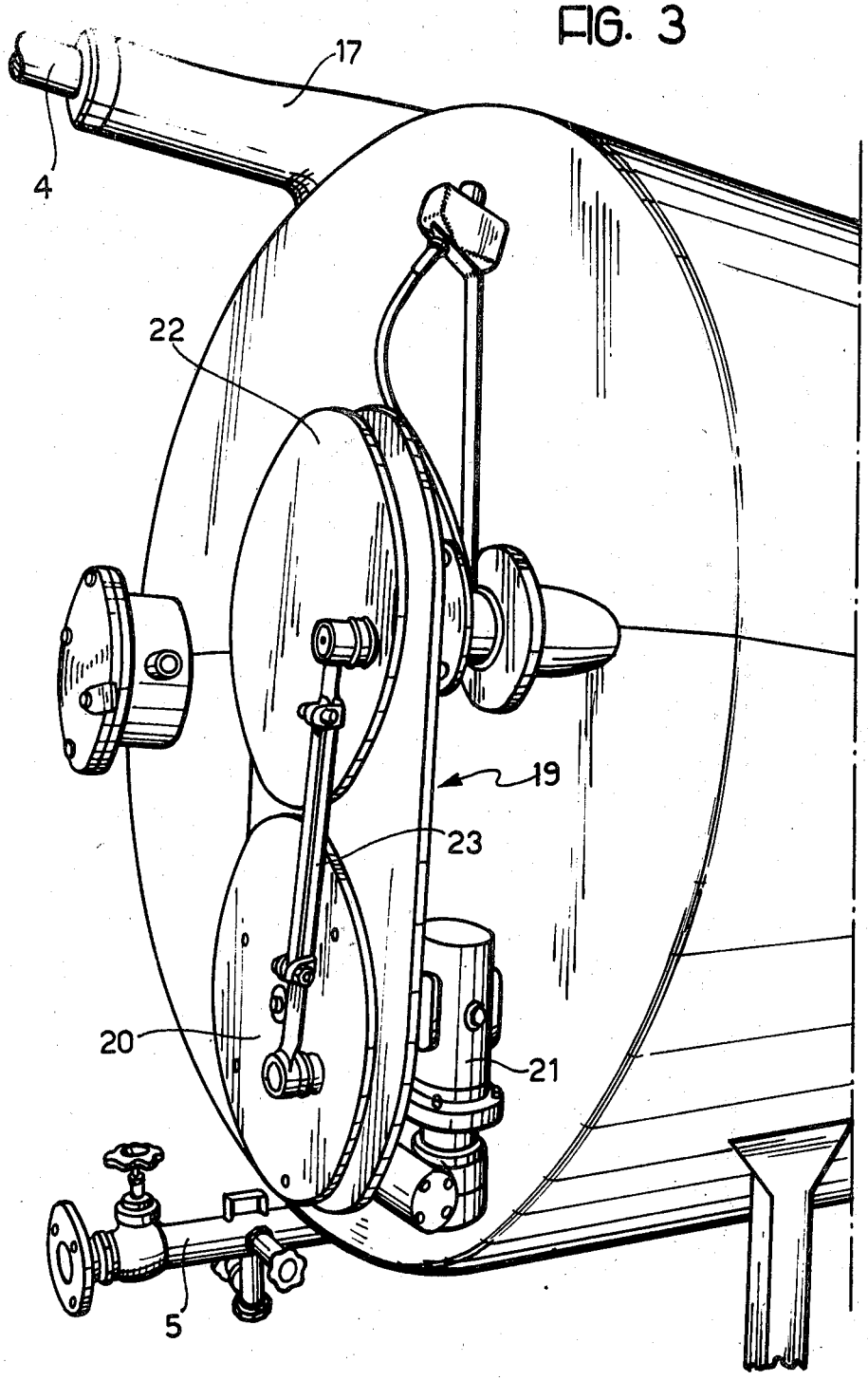
FIG. 3 is a perspective view of one end of a kiln, constructed according to the teachings of this invention.

As can be seen from FIG. 3, the nozzle 11 is controlled to reciprocate angularly by a crank mechanism 19. This mechanism comprises a driving wheel 20, driven by a geared down motor 21 mechanically connected to a driven wheel 22 by a connecting rod 23. The geometry of the two wheels 20 and 22 and of the connecting rod 23 is such that as the wheel 20 rotates the wheel 22 is caused to reciprocate angularly. Wheel 22 is connected to one end of the shaft 12 of the nozzle 11 so that the nozzle 11 reciprocates angularly with the wheel 22. Of course the motion of the nozzle 11 could be controlled by any other suitable mechanism which can produce an alternating cyclic movement rocking about the axis of the shaft 12 in a manner similar to that produced by the crank mechanism shown in the particular embodiment illustrated in the drawings.

In operation of the kiln the motor 16 drives the fans 15 to create a flow of air or whatever gas is contained in the chamber 9, which is divided into two currents in the conduits 6A and 6B, as shown in FIG. 1. Air flowing through these conduits draws heat from the hot wall 1, and the two currents of heated air join at the common outlet end of the ducts 6A, 6B and flow through the nozzle 11 from which emerges a jet of hot air which is played over the stack 10 of timber due to the angular movement of the nozzle 11. The jet of air reaches all parts of the stack of timber since it is directed, at different angles, directly onto one side of the stack. The jet of air penetrates perpendicularly through the face of the stack 10 when the nozzle 11 is in centre position, thus contacting very few layers of timber, but when inclined away from the central position the jet of air impinges on a greater area of the surface of the stack due to the inclination of the nozzle, and therefore a greater number of layers of timber are contacted by the jet of air. It will be appreciated that, driven as described, the nozzle 11 is travelling fastest when in its mid position affecting the smallest quantity of timber, and is travelling more slowly towards the end positions where the volume of timber affected by the jet of air from the nozzle is greater. In this way each piece of timber in the stack is subjected to substantially the same air flow during processing.

The nozzle 11 has a restricted narrow opening, as can be seen from FIGS. 1 and 2, and its reciprocating pivoting movement is such that while the jet of air is directed at one part of the stack 10 the remaining parts of the stack of timber are not subjected to an air flow. The length of time for which any piece of timber in the stack 10 has air flowing over it is less than the interval of time when that piece of timber does not have air flowing over it. For this reason the temperature difference between adjacent layers of the same piece of timber remains restricted to a few degrees centrigrade. The best results are obtained when this temperature difference between adjacent layers spaced by about 1 mm is lower than one tenth of a degree centrigrade. Preferably the duration of the time interval between successive applications of hot air to any one piece of timber in the stack 10 lies between 45 seconds and 120 seconds. The ratio between the time for which a piece of timber in the stack 10 is subjected to a flow of hot air and the time interval between successive such applications of hot air preferably lies between $\frac{1}{3}$ and 1/6.

In this way, the heat accumulated by the outside layers of the timber in the stack 10 has time to penetrate inside, without excessively steep temperature gradients being set up in the thickness of the timber.

The required uniformity of distribution of air through the stack of timber is obtained, contrary to the known methods in which an attempt is made to distribute a continuous and constant flow of air as uniformly as possible throughout the whole of a stack of timber within the kiln for the whole time, by directing hot air over such timber in the stack for successive short intervals spaced by intervals when no air is directed over that timber, so that, at the end of the process each piece of timber has been subjected to the same air flow as all the other pieces. Because the jet of air is directed successively over different parts of the stack it is possible to load the kiln partially without any disadvantage, particularly if, as in the embodiment described, the range of inclinations of the jet of air can be adjusted simply (in this embodiment by adjusting the length of the connecting rod 23). The flow of air over the timber is thus accurately controlled and stationary air pockets are avoided due to the pivoting movement of the nozzle 11.

A further advantage of the invention lies in the fact that the laths which separate adjacent layers of timber in the stack can be of one size and do not have to be different for different thicknesses of timber.

Vacuum kilns, which have a cylindrical shape, are particularly suited for this invention as the form of the conduits like 6A and 6B, for the circulation of air, is very simple, although kilns having other basic shapes can be used if required.

We claim:

1. In a timber drying kiln comprising a kiln chamber for a stack of timber to be dried and means for circulating within the chamber a drying gas for said stack of timber, said means comprising:

a nozzle opening directly into said chamber, means feeding said nozzle with a flow of said drying gas in heated condition thereby to produce a jet of hot drying gas from said nozzle, means movably mounting said nozzle so that the latter can be pointed in different directions across the chamber thereby to cause said jet to impinge onto different portions of a lateral face of a stack of timber in said kiln chamber, and means for controlling the movement of said nozzle whereby to direct the jet of gas sequentially over the entire lateral face of said stack of timber.

2. A timber drying kiln as in claim 1, wherein said means feeding said nozzle comprises a group of fans spaced from said nozzle across said kiln chamber in which the timber to be dried is stacked.

3. A timber drying kiln as in claim 1, wherein said means mounting said nozzle comprise pivotal mounting means, and a drive mechanism controlling said nozzle to reciprocate angularly.

4. A timber drying kiln as in claim 3, wherein said drive mechanism includes:

a crank lever, a motor driving said crank lever, a balance wheel, a connecting rod joining said crank lever to an eccentric point on said balance wheel, and a shaft on which said balance wheel is carried and to which said nozzle is connected.

5. A timber drying kiln as in claim 1, wherein there are provided two gas conduits between said nozzle and said group of fans, said two conduits embracing therebetween said kiln chamber in which the timber to be dried is stacked.

6. A timber drying kiln as in claim 5, wherein said kiln chamber comprises a main kiln wall, and a secondary wall located within and parallel to said main kiln wall, said two walls defining between them said two conduits for the gas.

7. A timber drying kiln as in claim 6, wherein said secondary wall is provided with heating means for raising the temperature of said wall to the required temperature.

8. A timber drying kiln as in claim 6, wherein said main wall is provided with heating means for raising the temperature of said wall to the required temperature.

9. A timber drying kiln as in claim 7, characterised in that said main kiln wall has a layer of thermal insulating material.

10. A timber drying kiln as in claim 5, wherein said two conduits are shaped to encourage turbulent flow.

11. A timber drying kiln as in claim 2 wherein said nozzle and said group of fans are located on two long sides of a generally cylindrical kiln chamber in positions diametrically opposite one another.

* * * * *